US009940773B2

(12) United States Patent
Winsor

(10) Patent No.: US 9,940,773 B2
(45) Date of Patent: Apr. 10, 2018

(54) SYSTEMS AND METHODS FOR AUTOMATED DISPENSING SYSTEMS IN RETAIL LOCATIONS

(71) Applicant: James Winsor, Riverside, CA (US)

(72) Inventor: James Winsor, Riverside, CA (US)

(73) Assignee: Accelerated Retail Technology, Inc., Corona, CA (US)

( * ) Notice: Subject to any disclaimer, the term of this patent is extended or adjusted under 35 U.S.C. 154(b) by 0 days.

(21) Appl. No.: 14/675,435

(22) Filed: Mar. 31, 2015

(65) Prior Publication Data

US 2015/0279147 A1 Oct. 1, 2015

Related U.S. Application Data

(60) Provisional application No. 61/973,182, filed on Mar. 31, 2014.

(51) Int. Cl.
*G07F 11/00* (2006.01)

(52) U.S. Cl.
CPC ..... *G07F 11/002* (2013.01)

(58) Field of Classification Search
CPC ..... G07F 11/00
See application file for complete search history.

(56) References Cited

U.S. PATENT DOCUMENTS 6,598,790 B1 * 7/2003 Horst ..... G07G 1/0036 235/375
2002/0032582 A1 * 3/2002 Feeney, Jr. ..... G06F 19/3462 705/2
2002/0077724 A1 * 6/2002 Paulucci ..... G06Q 20/20 700/231
2005/0216120 A1 * 9/2005 Rosenberg ..... G07F 9/02 700/244
2008/0033596 A1 * 2/2008 Fausak ..... G07F 9/026 700/244
2008/0097770 A1 * 4/2008 Low ..... G06Q 20/20 705/304
2010/0057871 A1 * 3/2010 Kaplan ..... G07F 9/026 709/206
2010/0268792 A1 * 10/2010 Butler ..... G06Q 30/02 709/217

(Continued)

*Primary Examiner* — Gene O Crawford
*Assistant Examiner* — Stephen L Akridge
(74) *Attorney, Agent, or Firm* — Carter, DeLuca, Farrell & Schmidt, LLP

(57) ABSTRACT

An automated vending system for retail locations can include: an exterior housing that houses a plurality of differently shaped items for purchase and return; a data processor that is disposed in the exterior housing and that is coupled to an external server having a database; a display device on a face of the exterior housing; a memory storing computer-executable instructions that cause the automated vending system to execute vending and returning of an item; a payment validation device that is configured to accept payment information; a storage area that holds a plurality of items; an item compartment that is disposed within the exterior housing and that is capable of opening to the user; an item dispenser that dispenses an item from the storage area to the item compartment; and a detector that is positioned to detect foreign activity within the item compartment.

19 Claims, 15 Drawing Sheets

(56) References Cited

U.S. PATENT DOCUMENTS

2010/0294938 A1* 11/2010 Alameh ..... G06F 3/0308
250/342
2013/0325176 A1* 12/2013 Polubinski, Jr. ..... G06F 17/00
700/237
2014/0147005 A1* 5/2014 Kavli ..... G07F 7/0609
382/103

* cited by examiner

SYSTEMS AND METHODS FOR AUTOMATED DISPENSING SYSTEMS IN RETAIL LOCATIONS

CROSS-REFERENCE TO RELATED APPLICATIONS

This application claims priority to U.S. Provisional Patent Application No. 61/973,182, filed Mar. 31, 2014 which is hereby incorporated herein by reference in its entirety.

FIELD

The embodiments described herein relate generally to automated self-service interactive product dispensing or redemption methods and systems, and, more particularly, to systems and methods that facilitate automated dispensing systems in retail locations.

BACKGROUND

Accompanying the general public's increased attraction with self-service technologies such as interactive touch displays, buttons, images signals, kiosks and automated dispensing/vending, is a growing interest in the interactive operation and interaction of the system during the event of retail POS purchasing or the potential purchasing process. The past and present state of the art for self-service automated systems support a self-service feature allowing for vending or dispensing of an item or product but typically do not have the means of complete control, unique or specific product identification, and/or product verification. Many methods and techniques have been used in the past or present by unattended self-service automated product dispensing systems to verify a product or item has been dispensed or removed from the system but presently there is no current methodology by unattended self-service automated product dispensing systems that offer or provide for a positive or definitive means of detecting that a specific or the exact item being returned or exchanged or redeemed by the customer or user has been solicited and received by a user or customer, and that the item can be verified as to its authenticity.

Thus, it is desirable to provide systems and methods that facilitate automated dispensing systems in retail locations.

SUMMARY

The embodiments described herein are directed to systems and methods that facilitate automated dispensing systems in retail locations. The embodiments of the self-service automated dispensing systems described herein support a self-service feature or utility allowing for the vending or dispensing of an item or product. In the embodiments, the systems include means that enable unique or specific product identification and/or product verification, customer analytics, product and system interaction, façade customization, and/or "form fit and function" within the standards of traditional and non-traditional retail store fixtures or merchandising fixtures, end caps or retail rows/columns or islands to dispense or interact with the product or redemption of a product or item. Using "form fit and function" in an unattended self-service automated product dispensing system as a means of system-user interaction can thereby increase and cause a higher probability of creating or completing a sales transaction.

Other systems, methods, features and advantages of the example embodiments will be or will become apparent to one with skill in the art upon examination of the following figures and detailed description.

BRIEF DESCRIPTION OF THE FIGURES

The details of the example embodiments, including structure and operation, may be gleaned in part by study of the accompanying figures, in which like reference numerals refer to like parts. The components in the figures are not necessarily to scale, emphasis instead being placed upon illustrating some principles of the invention. Moreover, all illustrations are intended to convey concepts, where relative sizes, shapes and other detailed attributes may be illustrated schematically rather than literally or precisely.

It should be noted that elements of similar structures or functions are generally represented by like reference numerals for illustrative purpose throughout the figures. It should also be noted that the figures are only intended to facilitate the description of the preferred embodiments.

DETAILED DESCRIPTION

Figure 1A:
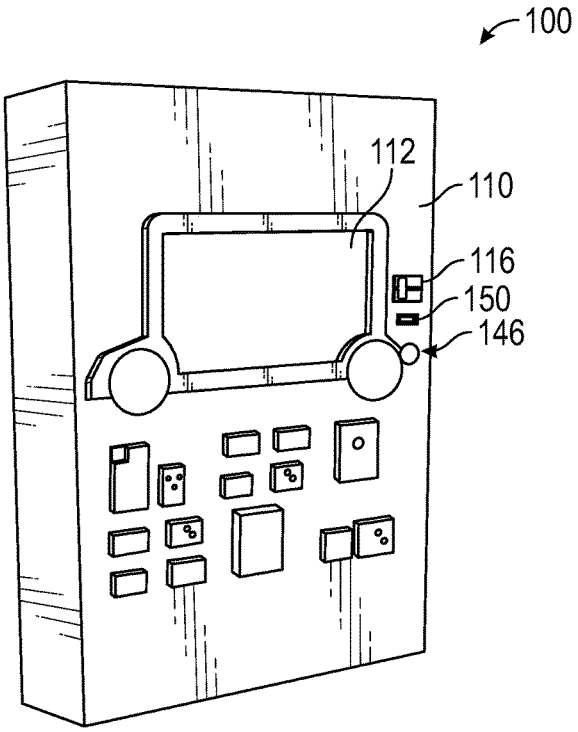
FIG. 1A shows a perspective view of an automated vending system, in accordance with an embodiment of the invention.

Each of the additional features and teachings disclosed below can be utilized separately or in conjunction with other features and teachings to produce systems and methods systems and methods that facilitate automated dispensing systems in retail locations. Representative examples of the present invention, which examples utilize many of these additional features and teachings both separately and in combination, will now be described in further detail with reference to the attached drawings. This detailed description is merely intended to teach a person of skill in the art further details for practicing preferred aspects of the present teachings and is not intended to limit the scope of the invention. Therefore, combinations of features and steps disclosed in the following detailed description may not be necessary to practice the invention in the broadest sense, and are instead taught merely to particularly describe representative examples of the present teachings.

Moreover, the various features of the representative examples and the dependent claims may be combined in ways that are not specifically and explicitly enumerated in order to provide additional useful embodiments of the present teachings. In addition, it is expressly noted that all features disclosed in the description and/or the claims are intended to be disclosed separately and independently from each other for the purpose of original disclosure, as well as for the purpose of restricting the claimed subject matter independent of the compositions of the features in the embodiments and/or the claims. It is also expressly noted that all value ranges or indications of groups of entities disclose every possible intermediate value or intermediate entity for the purpose of original disclosure, as well as for the purpose of restricting the claimed subject matter.

The term "computer" is intended to have a broad meaning that may be used in computing devices such as, e.g., but not limited to, standalone or client or server devices. The computer may be, e.g., (but not limited to) a personal computer (PC) system running an operating system such as, e.g., (but not limited to) MICROSOFT® WINDOWS® NT/98/2000/XP/Vista/Windows 7/8/etc. available from MICROSOFT® Corporation of Redmond, Wash., U.S.A. or an Apple computer executing MAC® OS from Apple® of Cupertino, Calif., U.S.A. However, the invention is not limited to these platforms. Instead, the invention may be implemented on any appropriate computer system running any appropriate operating system. In one illustrative embodiment, the present invention may be implemented on a computer system operating as discussed herein. The computer system may include, e.g., but is not limited to, a main memory, random access memory (RAM), and a secondary memory, etc. Main memory, random access memory (RAM), and a secondary memory, etc., may be a computer-readable medium that may be configured to store instructions configured to implement one or more embodiments and may comprise a random-access memory (RAM) that may include RAM devices, such as Dynamic RAM (DRAM) devices, flash memory devices, Static RAM (SRAM) devices, etc.

The secondary memory may include, for example, (but is not limited to) a hard disk drive and/or a removable storage drive, representing a floppy diskette drive, a magnetic tape drive, an optical disk drive, a compact disk drive CD-ROM, flash memory, etc. The removable storage drive may, e.g., but is not limited to, read from and/or write to a removable storage unit in a well-known manner. The removable storage unit, also called a program storage device or a computer program product, may represent, e.g., but is not limited to, a floppy disk, magnetic tape, optical disk, compact disk, etc. which may be read from and written to the removable storage drive. As will be appreciated, the removable storage unit may include a computer usable storage medium having stored therein computer software and/or data.

In alternative illustrative embodiments, the secondary memory may include other similar devices for allowing computer programs or other instructions to be loaded into the computer system. Such devices may include, for example, a removable storage unit and an interface. Examples of such may include a program cartridge and cartridge interface (such as, e.g., but not limited to, those found in video game devices), a removable memory chip (such as, e.g., but not limited to, an erasable programmable read only memory (EPROM), or programmable read only memory (PROM) and associated socket, and other removable storage units and interfaces, which may allow software and data to be transferred from the removable storage unit to the computer system.

The computer may also include an input device may include any mechanism or combination of mechanisms that may permit information to be input into the computer system from, e.g., a user. The input device may include logic configured to receive information for the computer system from, e.g. a user. Examples of the input device may include, e.g., but not limited to, a mouse, pen-based pointing device, or other pointing device such as a digitizer, a touch sensitive display device, and/or a keyboard or other data entry device (none of which are labeled). Other input devices may include, e.g., but not limited to, a biometric input device, a video source, an audio source, a microphone, a web cam, a video camera, and/or other camera. The input device may communicate with a processor either wired or wirelessly.

The computer may also include output devices which may include any mechanism or combination of mechanisms that may output information from a computer system. An output device may include logic configured to output information from the computer system. Embodiments of output device may include, e.g., but not limited to, display, and display interface, including displays, printers, speakers, cathode ray tubes (CRTs), plasma displays, light-emitting diode (LED) displays, liquid crystal displays (LCDs), printers, vacuum florescent displays (VFDs), surface-conduction electron-emitter displays (SEDs), field emission displays (FEDs), etc. The computer may include input/output (I/O) devices such as, e.g., (but not limited to) communications interface, cable and communications path, etc. These devices may include, e.g., but are not limited to, a network interface card, and/or modems. The output device may communicate with processor either wired or wirelessly. A communications interface may allow software and data to be transferred between the computer system and external devices.

The term "data processor" is intended to have a broad meaning that includes one or more processors, such as, e.g., but not limited to, that are connected to a communication infrastructure (e.g., but not limited to, a communications bus, cross-over bar, interconnect, or network, etc.). The term data processor may include any type of processor, microprocessor and/or processing logic that may interpret and execute instructions (e.g., for example, a field programmable gate array (FPGA)). The data processor may comprise a single device (e.g., for example, a single core) and/or a group of devices (e.g., multi-core). The data processor may include logic configured to execute computer-executable instructions configured to implement one or more embodiments. The instructions may reside in main memory or secondary memory. The data processor may also include multiple independent cores, such as a dual-core processor or a multi-core processor. The data processors may also include one or more graphics processing units (GPU) which may be in the form of a dedicated graphics card, an integrated graphics solution, and/or a hybrid graphics solution. Various illustrative software embodiments may be described in terms of this illustrative computer system. After reading this description, it will become apparent to a person skilled in the relevant art(s) how to implement the invention using other computer systems and/or architectures.

The term "data storage device" is intended to have a broad meaning that includes removable storage drive, a hard disk installed in hard disk drive, flash memories, removable discs, non-removable discs, etc. In addition, it should be noted that various electromagnetic radiation, such as wireless communication, electrical communication carried over an electrically conductive wire (e.g., but not limited to twisted pair, CAT5, etc.) or an optical medium (e.g., but not limited to, optical fiber) and the like may be encoded to carry computer-executable instructions and/or computer data that embodiments of the invention on e.g., a communication network. These computer program products may provide software to the computer system. It should be noted that a computer-readable medium that comprises computer-executable instructions for execution in a processor may be configured to store various embodiments of the present invention.

In the preceding description and subsequent claims, the terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

The embodiments described herein are directed to systems and methods that facilitate automated dispensing systems in retail locations. Turning to FIG. 1, an automated vending system 100 for retail locations can include an exterior housing 110 configured to house a plurality of differently shaped items for purchase and return.

As shown in FIG. 1A, the automated vending system 100 can include a display device 112 on a face of the exterior housing 110. The display device 112 can be configured to accept user input for executing a transaction, such as, for example, vending at least one item or product and/or returning the at least one item or product. Thus, FIG. 1A is an illustration of an embodiment of an automated self-service product dispensing system 100 includes a display and dispensing module controlled by a PC or other electronic control board is shown. As depicted, there are multiple methods used for controlling a single system or a plurality of systems. According to one embodiment, the automated dispensing system includes a transaction detection and/or verification system ("verification system") and related methods.

Figure 2:
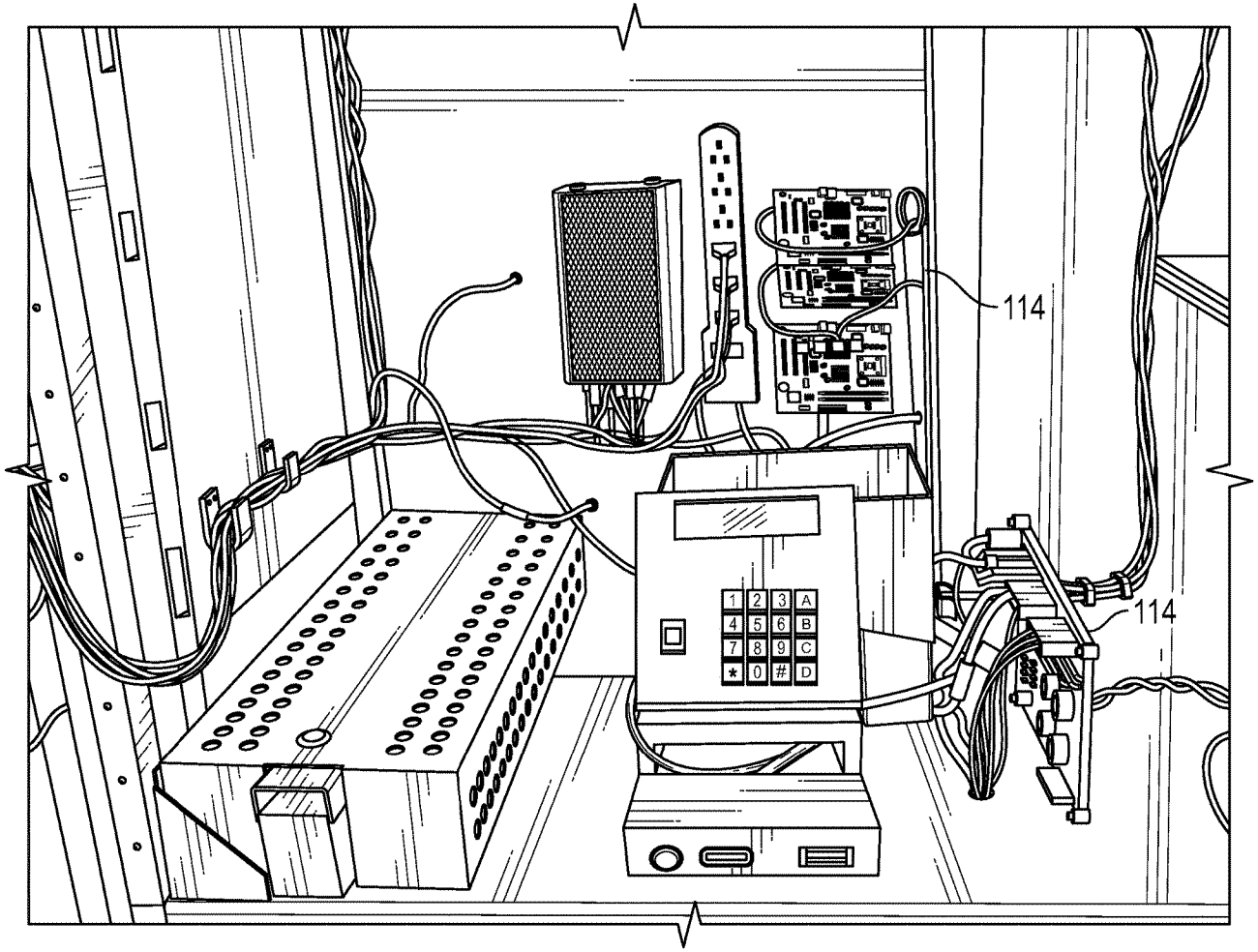
FIG. 2 shows an inside region of an automated vending system, in accordance with an embodiment of the invention.
Figure 4A:
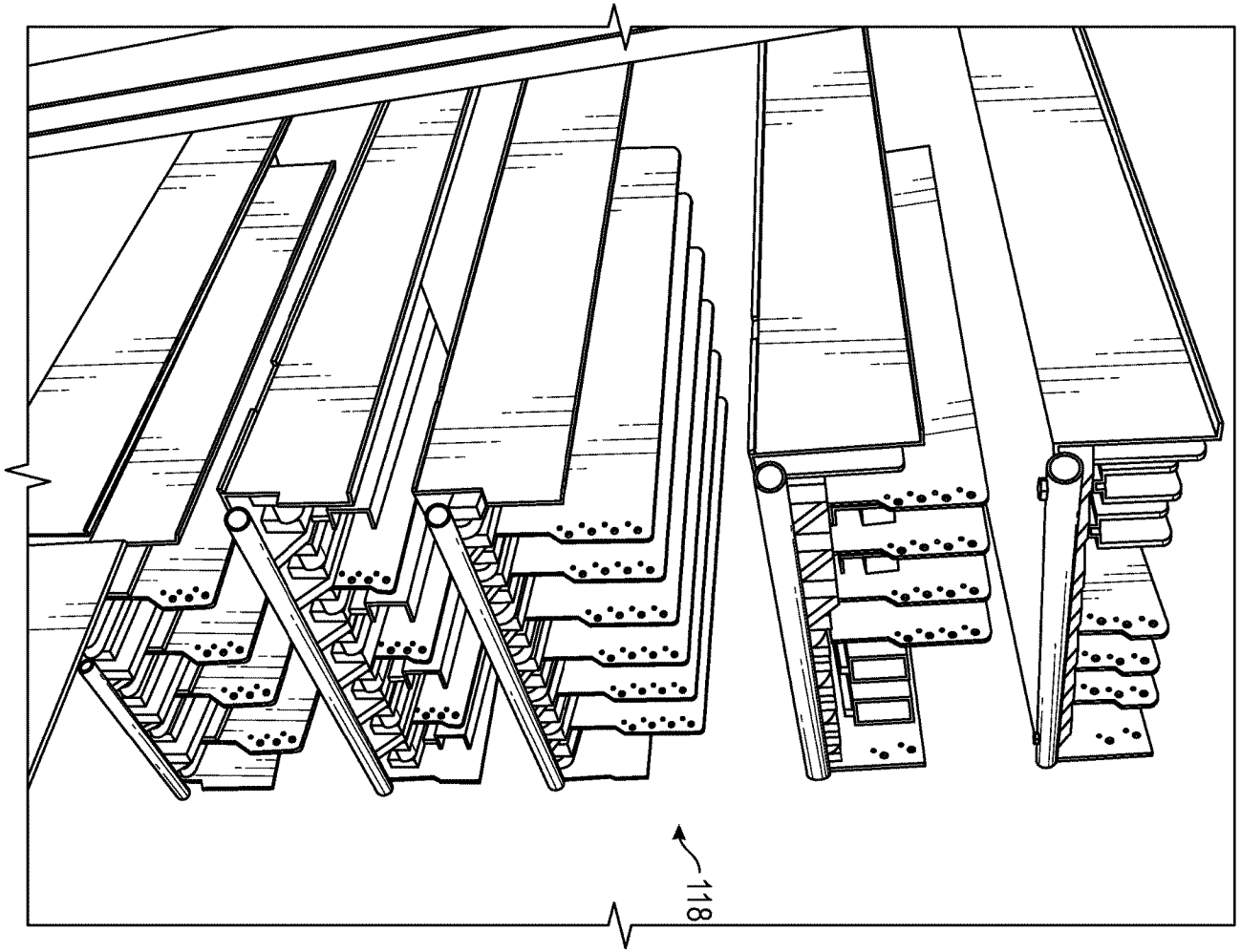
FIG. 4A shows a storage region for storing items having a dispenser in an automated vending system, in accordance with an embodiment of the invention.

As shown in FIG. 2, the automated vending system 100 can include at least one data processor 114 that is disposed in the exterior housing 110 and that is coupled to an external server having a database. FIG. 4A shows an interior space that houses the plurality of differently shaped items for purchase and return. FIG. 4A shows that the automated vending system 100 can include a memory storing computer-executable instructions that, when executed by the at least one data processor 114, can cause the automated vending system 100 to execute vending and returning of at least one item of interest.

FIG. 1A shows that the automated vending system 100 can include a payment validation device 116 that is configured to accept payment information from a user, using the data processor. The payment validation device 116 can be disposed on or in the exterior housing of the automated vending system 100.

Figure 4B:
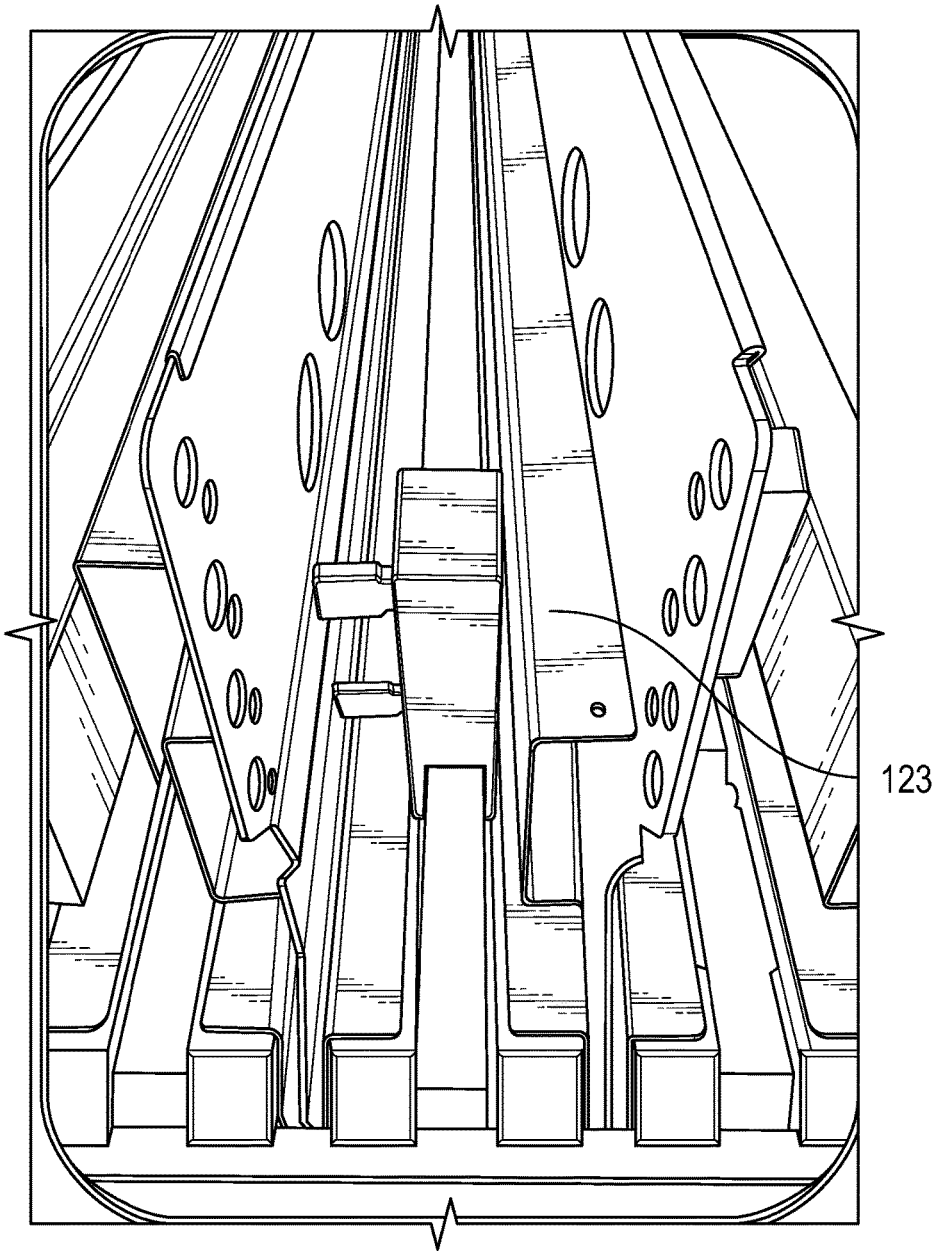
FIG. 4B shows a close-up view of a dispenser in an automated vending system, in accordance with an embodiment of the invention.
Figure 5A:
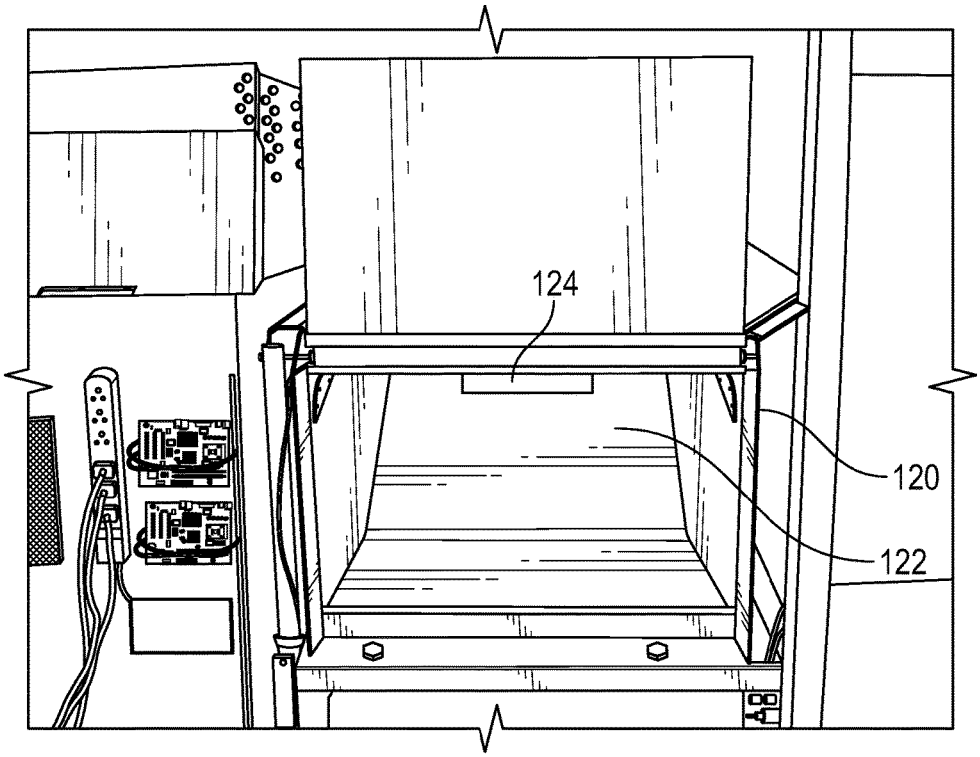
FIG. 5A shows an item compartment in an interior region of an automated vending system, in accordance with an embodiment of the invention.
Figure 5B:
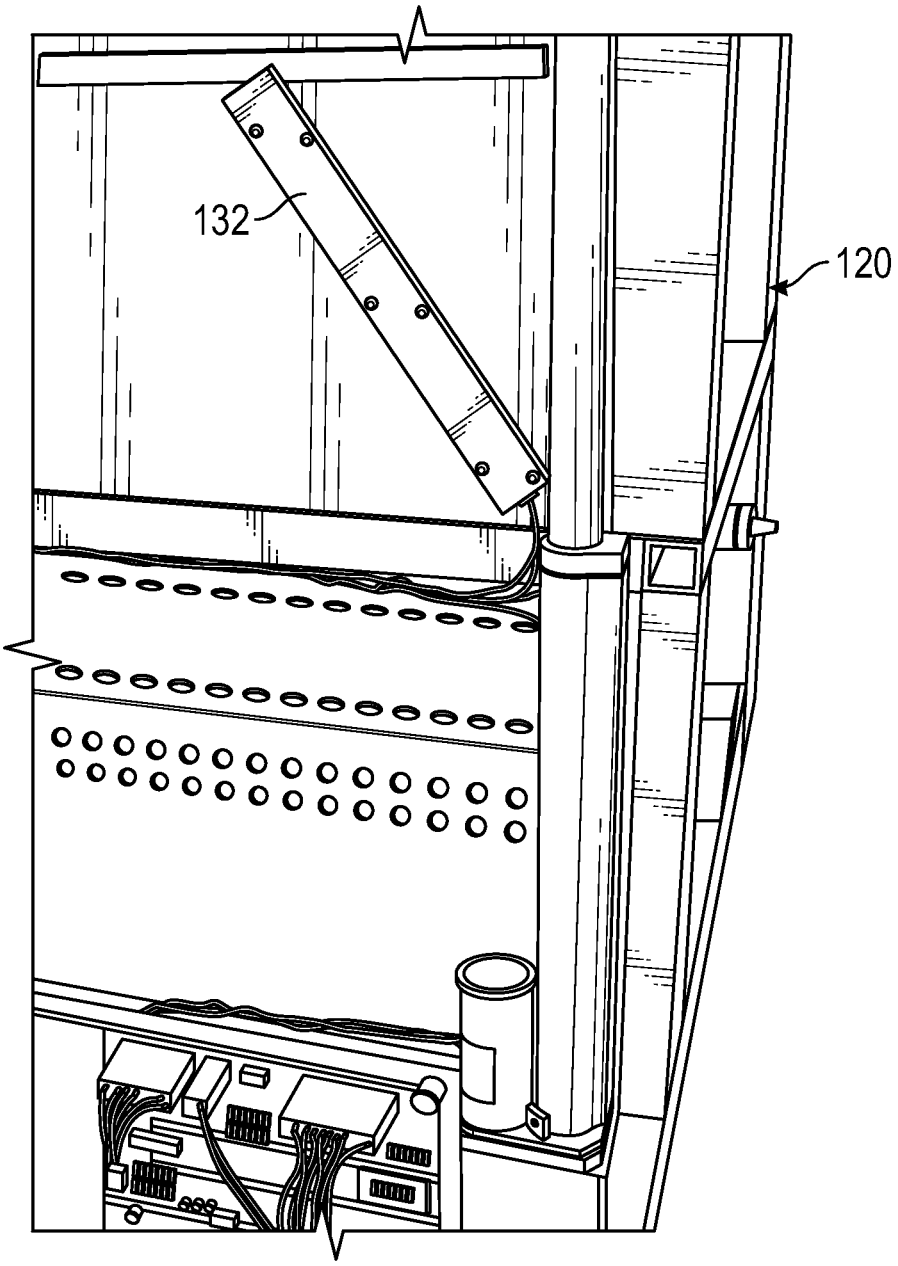
FIG. 5B shows a side view of an item compartment in an interior region of an automated vending system, in accordance with an embodiment of the invention.
Figure 6:
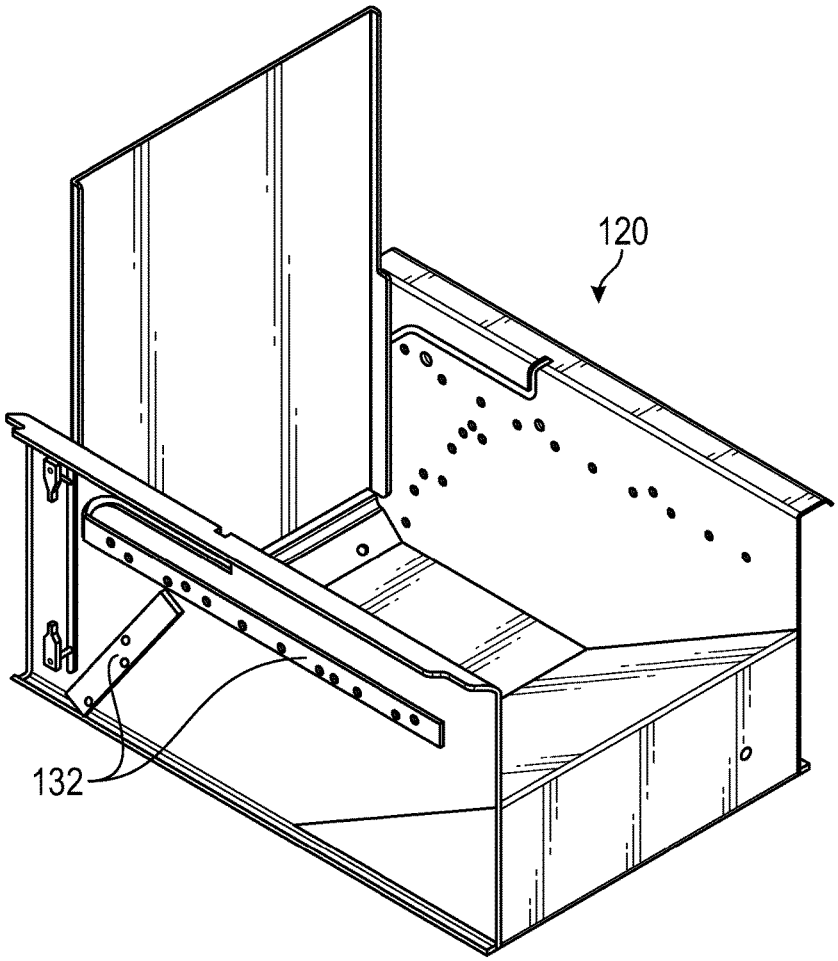
FIG. 6 shows an interior perspective of an item compartment of an automated vending system, in accordance with an embodiment of the invention.

FIG. 4A shows that the automated vending system 100 can include a storage area 118 that is configured to hold a plurality of items. The storage area 118 can be inside the exterior housing 110. As seen in FIG. 5B or 6, the automated vending system 100 can include an item compartment that is disposed within the exterior housing 110 and that is capable of opening to the user, using the data processor 114. As shown in FIGS. 4B and 5A, the automated vending system 100 can include an item dispenser 122 that is configured to dispense, using the data processor 114, an item from the storage area to the item compartment 120. Specifically, FIG. 4B shows that a pusher 123, which is connected to the storage device, can apply pressure on an item that is being stored in the storage area 118 and move the item closer to the item compartment or to the chute or slide. The dispenser 122 can include a chute or a slide that facilitates the item to reach the item compartment 120. The automated vending system 100 can include a detector 124 that is positioned to detect foreign activity within the item compartment 120, using the at least one data processor 114. FIG. 5A shows a frontal view of the output from the slide or chute after an item has been dispensed.

Figure 3:
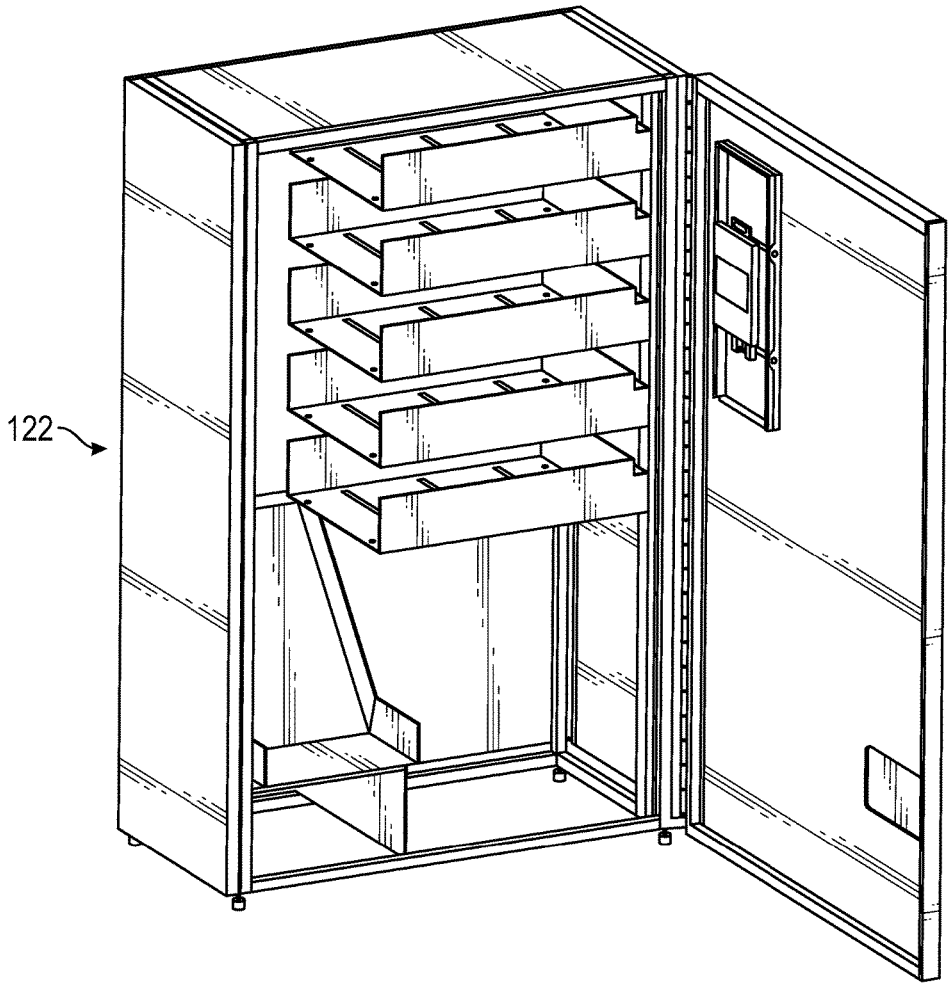
FIG. 3 shows an interior region of an automated vending system, in accordance with an embodiment of the invention.

As shown in FIG. 3, products can be stored toward a top portion of an interior region of an automated vending system and in conjunction with a slide can be dispensed to the user. Thus, an automated dispensing system for retail locations is described that includes a display and dispensing module, a computer integrated into the module to control the operation of the module, and a façade configured for a retail location. The façade may resemble a product or item to be dispensed.

Some embodiments regarding vending an item will now be described. When the accepted user input corresponds to vending at least one item of interest, the display device 112 can be configured to accept user input for selecting the at least one item of interest. In one embodiment, upon the user selecting an item for purchase, the display device can offer related items for sale. The payment validation device 116 can be configured to accept payment from the user. The payment information can be received from a user's payment device. The vending can include i) validating the user's payment device, ii) verifying that sufficient space in the item compartment exists for the selected at least one item, iii) using the detector to detect fraud based on improper user activity being detected, and iv) dispensing the item to the compartment based on the validating, verifying and detecting fraud.

The dispensing can take place in a number of ways. For example, when the accepted user input corresponds to purchasing two or more items, each selected item can be sequentially dispensed. By sequentially dispensing, the item dispenser can dispense a first item to the item compartment and not dispense a next item until a predetermined event. One example of a predetermined event taking place is a user removing the first item from the item compartment and/or removing the user's hand from the item compartment. Thus, the predetermined event can be detecting that the first item and foreign activity are free from the item compartment and/or the predetermined event can include detecting a hand that removes the first item. In another embodiment, when the accepted user input corresponds to purchasing two or more items, the item dispenser can dispense the two or more selected items at once instead of sequentially dispensing the two or more selected items.

Figure 5C:
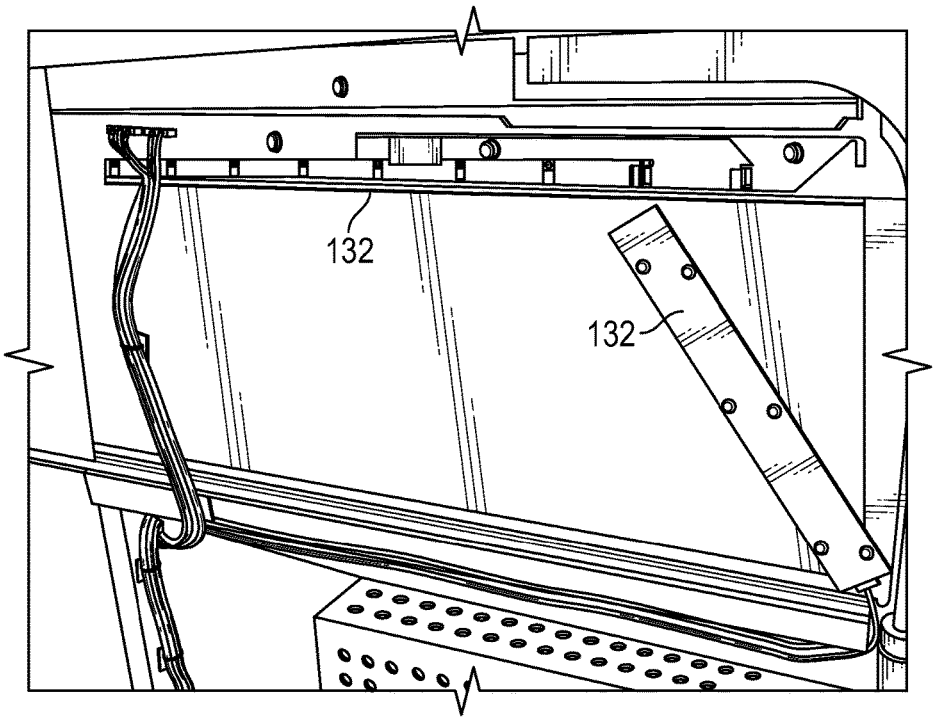
FIG. 5C shows sensors mounted to an exterior surface of an item compartment, in accordance with an embodiment of the invention.

The returning of an item is now described. In one embodiment, the database of the automated vending system 100 can include information about a plurality of items. FIG. 5B or 6 shows that the item compartment 120 can include at least one image sensor 132 that is configured to take a plurality of images of an item to be placed in the compartment by the user. FIG. 5C shows a view where image sensors 132 are positioned outside the item compartment 120. An image sensor 132 can detect movement in addition to capturing images. The item compartment 120 can also include a scale 134 that is configured to weigh the item to be placed in the compartment. When the accepted user input corresponds to returning at least one item, the at least one item can be returned based on the at least one image sensor 132 and the scale 134 generating data that matches the item to the information of the item in the database. In an embodiment, the item placed in the item compartment 120 can be imaged by a plurality of image sensors 132 to provide multiple views of the item. In one embodiment, six image sensors surrounding the item (i.e., top, left-side, right-side, back-side, front-side, and bottom) can provide six different perspectives of the item. Thus, the automated vending system 100 can include a verification system.

The verification system can include one or more system devices used in concert with the computer to identify the dispense product to allow return of, exchange of or redemption of the dispensed product. The verification system can include a primary means for positive identification of the dispensed product. The primary means for positive identification of the dispensed product can be a camera or video camera or combination configured to automatically capture an image of the prospective dispensed product for return, exchange or redemption and compare the image by means of the computer to that of a known or acceptable image stored in a database.

Such verification system is preferably configured to positively identify the defined item, i.e., a product or item being returned, exchanged or redeemed by the system, by one or more system devices used in concert with the system's electronic control for identification to allow return of, exchange of or redemption of the defined item. As an example, a primary means for positive identification is that of a camera or video camera or combination of to be used to automatically capture an image of the prospective item for return, exchange or redemption and compare the image by means of a PC or equivalent to that of a known or acceptable image stored in a data base. A positive "match" of the image will allow return, exchange or redemption of the item to the unattended self-service automated systems. A "non-match" of the item will be cause for rejection of return, exchange or redemption of the said item. Likewise, different items for return, exchange or redemption may require a combination or multiple combinations of methods and devices to correctly identify the return, exchange or redemption of the said item. These devices are identified in the claims section of this document.

A definitive means is contemplated within the scope of the present invention for providing positive identification and return of, detection of, verification of, a product, merchandise, item, article, thing, commodity, goods, article of trade, system, to or from a single or plurality of unattended self-service automated product dispensing system automated system. Thus, the automated vending system 100 can include positive identification and detection of, verification of, a product, merchandise, item, article, thing, commodity, goods, article of trade, system, to or from a single or plurality of unattended self-service automated product dispensing system automated product dispensing system for the purpose of being dispensed.

Many methods and techniques have been used in the past or present by unattended self-service automated product dispensing system automated systems to verify a product or item has been dispensed or removed from the system but presently there is no current methodology by unattended self-service automated product dispensing system automated system that offer or provide for a positive definitive means of detecting a specific or that the exact item that has been solicited by a user or customer being returned or exchanged or redeemed by the customer or user and that can be verified as to its authenticity.

One aspect of the present invention aims to positively identify the product or item being returned, exchanged or redeemed by the system by one or more system devices used in concert with the systems electronic control for identification to allow return of, exchange of or redemption of the defined item. A primary means for positive identification is that of a camera or video camera or combination of to be used to automatically capture an image of the prospective item for return, exchange or redemption and compare the image by means of a PC or equivalent to that of a known or acceptable image stored in a database. A positive "match" of the image will allow return, exchange or redemption of the item to the unattended self-service automated systems. A "non-match" of the item will be cause for rejection of return, exchange or redemption of the said item. Likewise, different items for return, exchange or redemption may require a combination or multiple combinations of methods and devices to correctly identify the return, exchange or redemption of the said item. These devices are identified in the claims section of this document.

The automated self-service product dispensing system may include one or more of all the aforementioned identification means, and may also including various means of detecting and tracking the product, validating the product, interacting with the product or with the system for the purpose of securing the items which may include the inclusion of a video camera, an ultrasonic sensor, RF tag or devise, a NFC (Near Field Communication) component, an interactive "Bluetooth" or other means of wireless identification such as "Wi-Fi" or connectivity for the purposes of interaction with the automated self-service product dispensing system that are dispensed which are also the basis for this invention.

Figure 10:
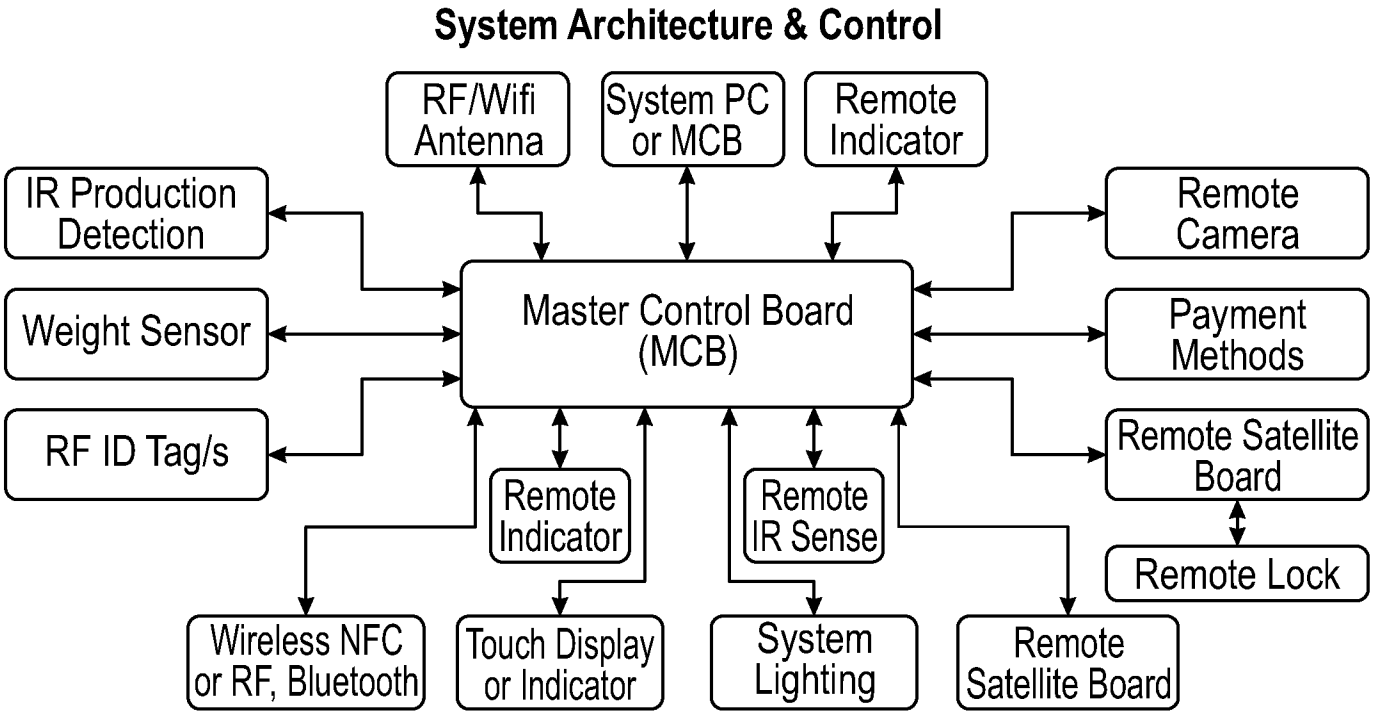
FIG. 10 depicts a block diagram of an automated self-service product dispensing system controlled by a PC or Electronic Control Board, in accordance with an embodiment of the invention.
Figure 12:
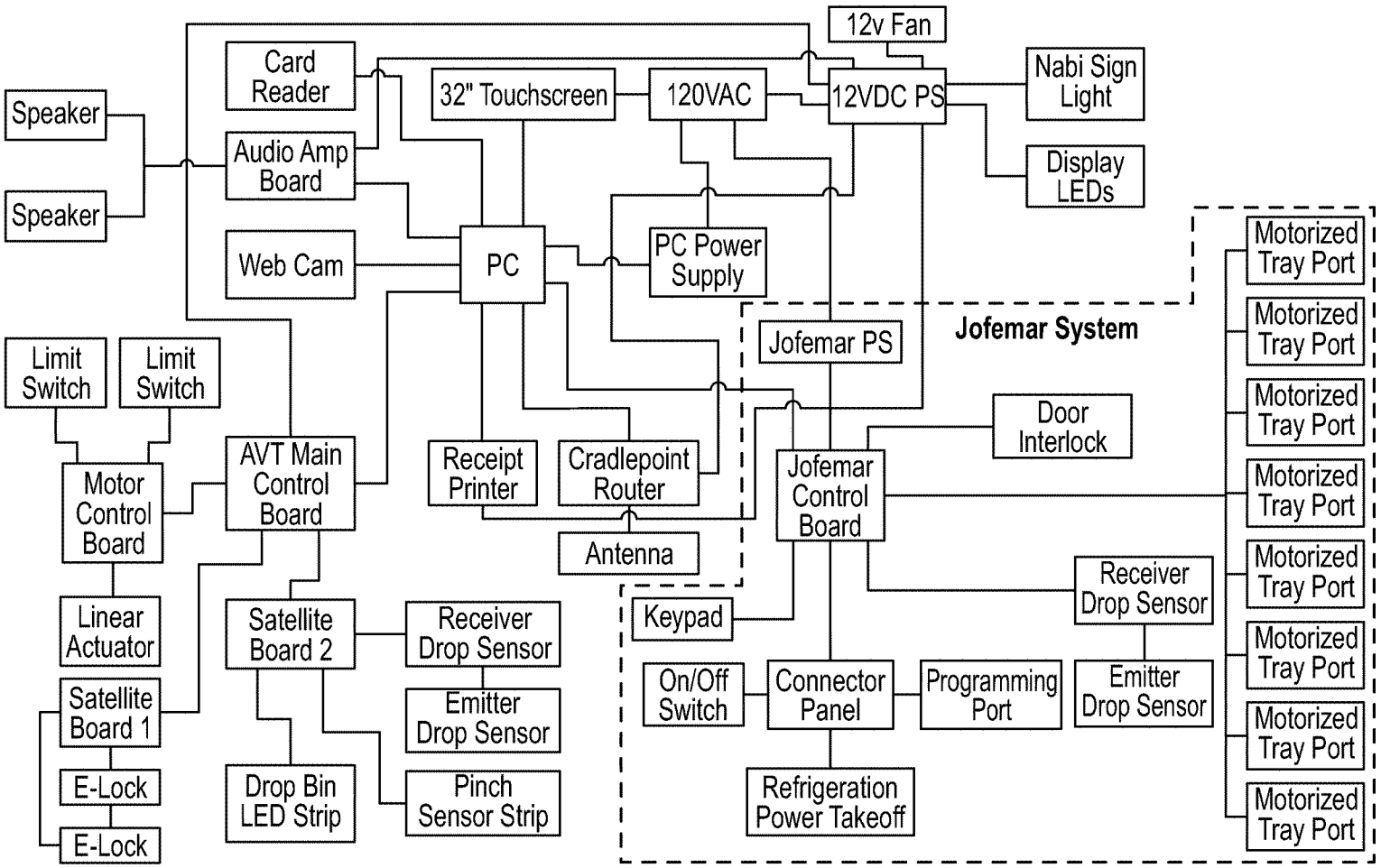
FIG. 12 is a schematic representation of some electrical components of an automated vending system, according to an embodiment of the invention.

A definitive means for providing positive identification, detection of, and/or verification of a product, merchandise, item, article, thing, commodity, goods, article of trade, system, to or from a single or plurality of unattended self-service automated product dispensing systems may include one or more of the following: a Web Camera, a PC Camera, a Video Camera, a Radio Frequency ID Tag, a Sonic or Sonar Beam, a Radio Frequency, an Infrared Light Beam, a Weight Scale, a Blue Tooth Technology, a Weight Matt, a laser or bar code scanner, an imager, a CCD Scanner, a Camera Scanner, a Laser Scanner, a Proximity Sensor or Switch, a Capacitive Proximity Sensor, an Inductive Proximity Sensor, a Magnetic Strip, an Electro Magnet, a RF ID, an Electrical Switch, a Pressure Transducer, a Cellular Video Camera, a Photocell, a Conductive Wire, a Non Conductive Wire or Cord, a Touch Sensor, a Conductive Plates, a Capacitive Plates, a Pressure Plates, an Inductive Coil, and a Magnetic Field. FIG. 10 displays how some definitive means for providing positive identification can interface with a data processor or master control board (MCB). FIG. 12 displays how some definitive means and other components of an automated vending system interact with a PC having at least one data processor.

The memory can further include computer-executable instructions that, when executed by the data processor 114, connect to the database to determine whether the user's payment information has a history of fraudulent returns. The computer-executable instructions can also be executed to compare images from the at least one image sensor 132 to identify the item to be returned. The computer-executable instructions can also be executed to verify that a weight of the item corresponds with a predefined weight of the item in the database. The computer-executable instructions can also be executed to determine that a return is appropriate based on the steps of determining the history, comparing the images, and verifying the weight.

Figure 7:
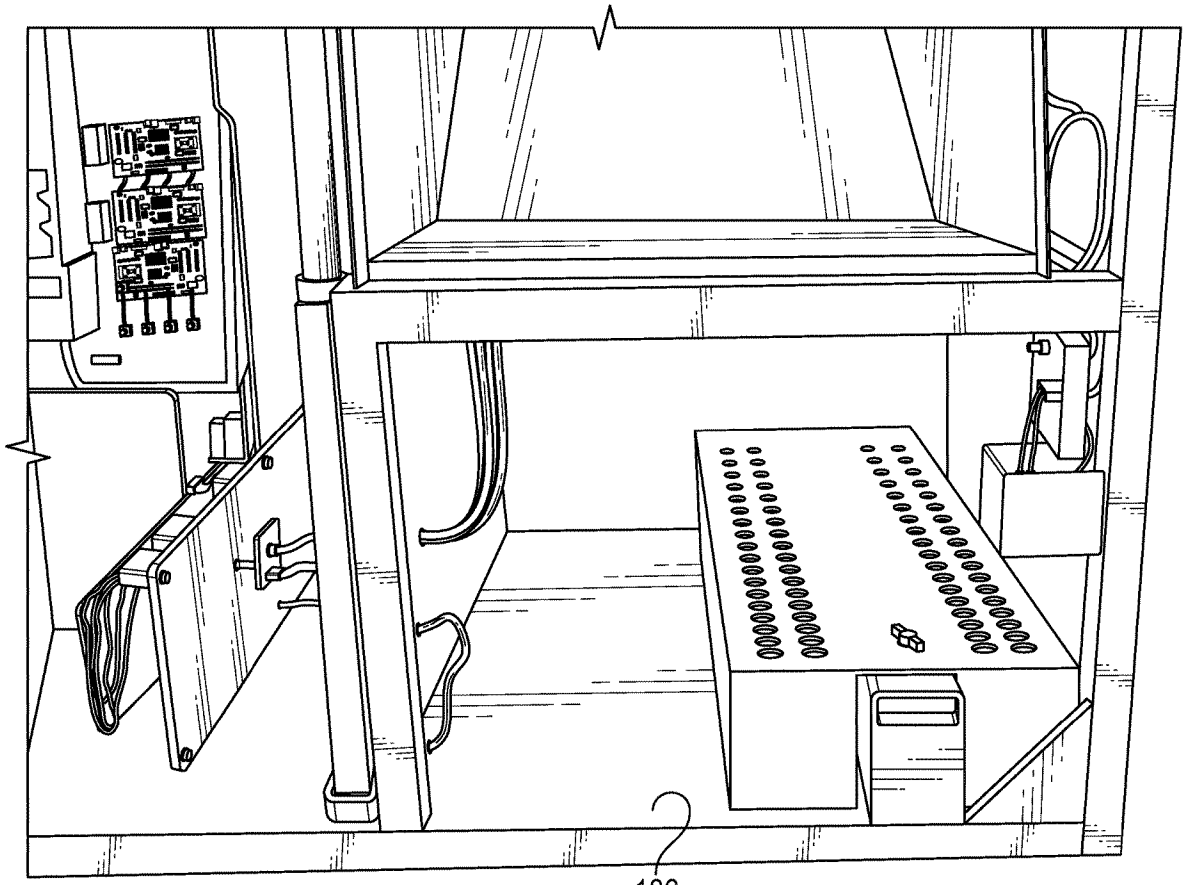
FIG. 7 shows a bin beneath an item compartment of an automated vending system, in accordance with an embodiment of the invention.
Figure 8:
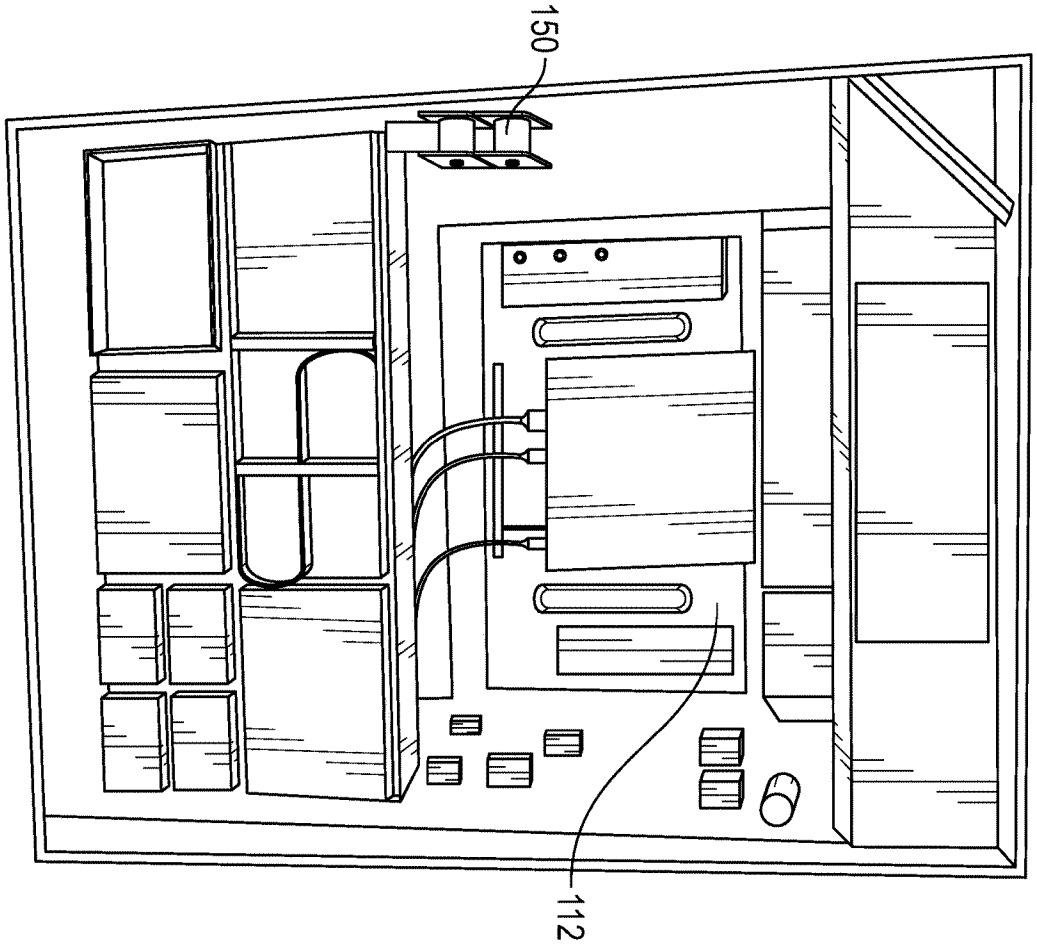
FIG. 8 shows an interior region of a back-view of an automated vending system, in accordance with an embodiment of the invention.

FIG. 7 shows that the automated vending system 100 can also include a return bin 136. In this embodiment, the memory can further include computer-executable instructions that, when executed by the data processor when it has been determined that a return is appropriate, cause the at least one item to be transported to the return bin 136. The return bin 136 can be directly beneath the item compartment 120 in an embodiment. In another embodiment, the return bin 136 can be on a same level as the item compartment 120 or above the item compartment 120. Further, when the at least one item has been returned, the user can be prompted to receive a return of a monetary value of the returned item, an exchange of the monetary value of the item for an item of equal or lesser value, or a redemption ticket for redeeming the item at a future time and/or at another location, as shown in FIG. 8. As seen from FIG. 1A, the redemption ticket can be dispensed through a redemption ticket dispenser 150. According to another embodiment, the automated dispensing system includes systems and methods that use a smart phone or cellular device software application to facilitate system-user interaction. Using "smart phone or cellular device software application" with an unattended self-service automated product dispensing system as a means of system-user interaction can thereby increase and cause a higher probability of creating or completing a sales transaction. Such an application may include the redemption of a product, item or comity from or at an unattended self-service automated product dispensing system by such means as a redemption ticket, or a onetime use claim number. The redemption of a product, item or comity from or at an unattended self-service automated product dispensing system by such means as a "redemption ticket," or a onetime use claim number is also used and identified specifically as a utility of this invention as a means of system-user interaction thereby increasing completing or causing a higher probability of creating or completing a sales transaction.

The design, "physical appearance or shape" specifically for the purposes of automated self-service product dispensing system can also be identified specifically as a utility of this invention as a means of system-user interaction thereby increasing completing or causing a higher probability of creating or completing a sales transaction.

Figure 11:
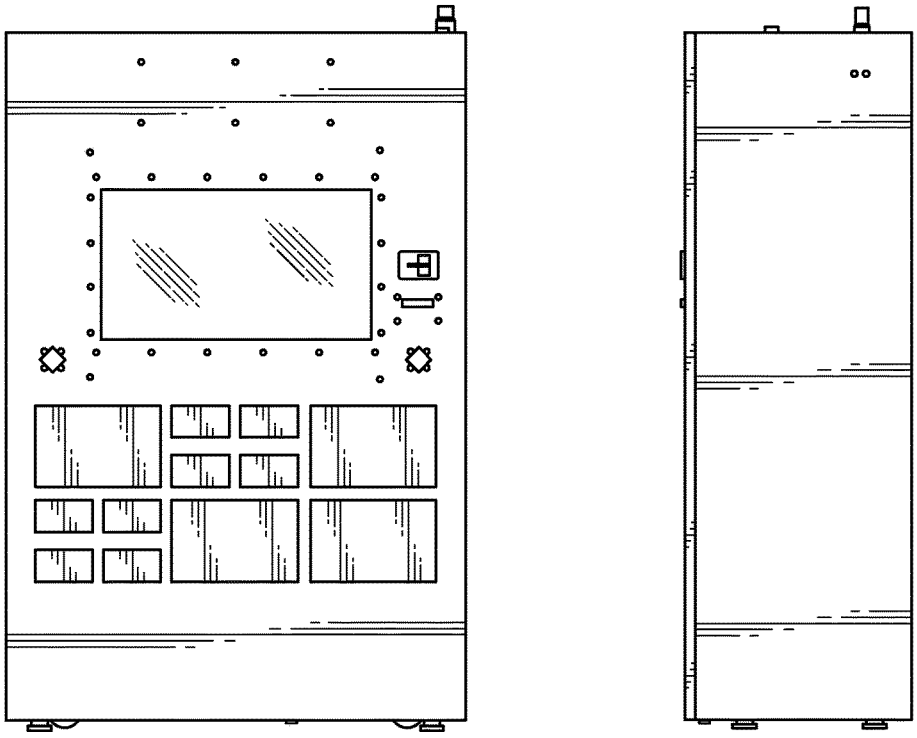
FIG. 11 shows an image diagram of a system of automated self-service product dispensing system according to physical dimensions appropriate to the placement within a retail stores "End Cap" or "Inline Isle" or Island or Foyer, in accordance with an embodiment of the invention.

According to another embodiment, the automated dispensing system includes a physical display of the product or products for sale and dispensing to facilitate system-user interaction specifically for the purposes of automated self-service product dispensing system is also identified specifically as a utility of this invention as a means of system-user interaction thereby increasing completing or causing a higher probability of creating or completing a sales transaction. A physical display of the product for sale specifically for the purposes of automated self-service product dispensing system is also identified specifically as a utility of this invention as a means of system-user interaction thereby increasing completing or causing a higher probability of creating or completing a sales transaction. In one embodiment, the automated vending system can be positionable within merchandising fixtures, end caps or retail rows/columns or islands of retail stores. Further, the exterior housing 110 can have a width of about 48" and a height of about 60" and a depth of 24". FIG. 11 shows a system of automated self-service product dispensing system according to physical dimensions appropriate to the placement within a retail stores "End Cap" or "Inline Isle" or Island or Foyer, in accordance with an embodiment of the invention.

According to another embodiment, the automated dispensing system includes a physical appearance or shape, as depicted in FIG. 3, that facilitates "form fit and function" for implementing automated dispensing systems in retail locations wherein the system is positionable within the merchandising fixtures, end caps or retail rows/columns or islands, and other locations such as the parking lot, and in the middle of a retail store column, island or isle, to dispense. The automated dispensing system may also be configured as mobile units to facilitate strategic positioning using single or multiple unattended self-service automated product dispensing system as a means of ambulatory use or recovery in retail locations such as parking lots, specific retail events or other. Thus, the automated vending system can be configured as a mobile unit for ambulatory use or recovery in retail locations.

The "Relative POS Position" such as the specific placement of the End Cap of the system——specifically for the purposes of automated self-service product dispensing system is also identified specifically as a utility of this invention as a means of system-user interaction thereby increasing completing or causing a higher probability of creating or completing a sales transaction.

The "Relative Retail Property Position" such as the parking lot specific placement strategically in the middle of a retail store column, island or isle—specifically for the purposes of automated self-service product dispensing system is also identified specifically as a utility of this invention as a means of system-user interaction thereby increasing completing or causing a higher probability of creating or completing a sales transaction.

Figure 9:
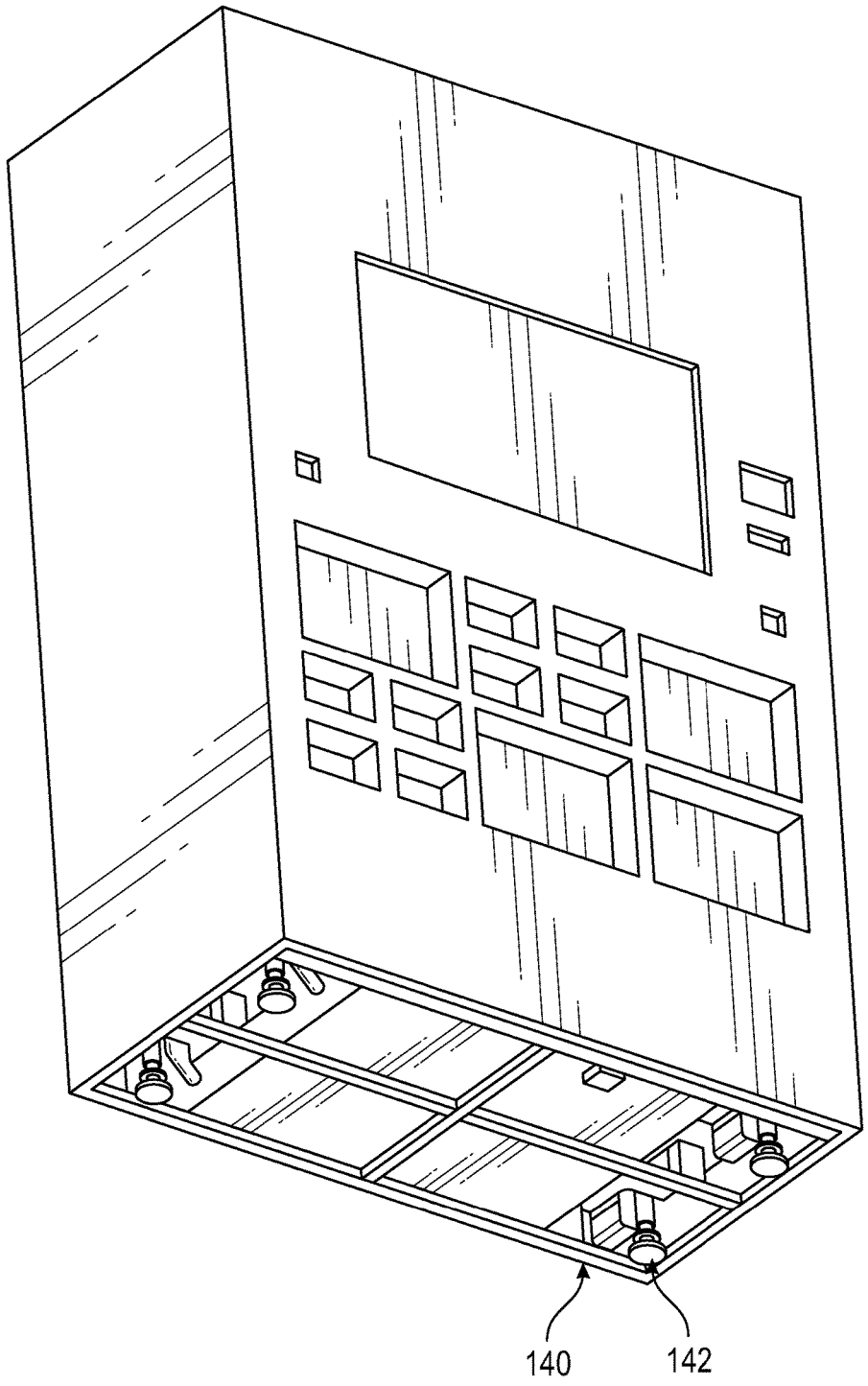
FIG. 9 shows a bottom view of an automated vending system, in accordance with an embodiment of the invention.

FIG. 9 shows that the automated vending system can include a plurality of wheels 140 attached to a bottom face of the automated vending system; and leveling feet 142 that are adjustable to a height greater than a height of the wheels. As shown in FIG. 1A, the automated vending system 100 can also include an audio output device 146 that is configured to produce sounds, the audio output device being tailored to output according to each step of the transaction. The design having interactive "sound" or audio interaction specifically for the purposes of automated self-service product dispensing system is thus a utility of one embodiment of the invention as a means of system-user interaction thereby increasing completing or causing a higher probability of creating or completing a sales transaction.

The automated dispensing system 100 may include an integrated "Desensitizer" as a means of deactivating an RF or magnetic theft deterrent security strip for allowing the product to be removed from the retail location without setting off the retails stores alarm system. Thus, the automated vending system 100 can include an integrated desensitizer that deactivates theft-deterrent strips upon executing the transaction.

In one embodiment, the automated vending system 100 can include a user-facing image sensor 148 mounted on or in the face of the exterior housing 110. In this embodiment, upon sensing a human within a predetermined range of the automated vending system 100, the image sensor 148 can capture an image of the human. In one embodiment, the predetermined range is within two feet of the user-facing image sensor 148. The image of the human can be analyzed for demographic information and matched using images from a certain subset of images stored in the database. The subset can be defined by geographical area. For example, in one embodiment, the subset relates to images that have been captured in the specific retail store where the automated vending system is located. In another embodiment, the subset relates to images that have been captured within a mile radius. The subset can also expand geographically to city, county, state or multi-state limits. The display device can provide content customization based on the analyzed and matched image. For example, depending on the user's demographical information, targeted offers or products can be displayed on the display device.

In one embodiment of the present invention, a plurality of automated vending systems 100 is contemplated where each of the automated vending systems are connected to the external server and where a transaction at one automated vending system can be used at another automated vending system. In this embodiment, each of the automated vending systems can be connected to a central external server.

In another embodiment, as seen on FIG. 1A, an automated vending system 100 can include a personal identification input device 150 that accepts personal information from the user. In this embodiment, the personal information can be matched against historical data of the user and/or personal reference data of the user. The display device 112 can be configured to display customized content to the user based on the matched personal information. According to another embodiment, the automated dispensing system includes systems and methods that use customer analytics to provide a customized customer experience or interaction. For example, if a young male child approaches the machine, the system tailors the screen presentation to include products to be dispensed that would be attractive to a young male child. Further, the system can be used to discover and convey a wide array of social media interaction to suggest and identify relational products.

According to another embodiment, the automated dispensing system includes systems and methods that use product and system interaction to facilitate system-user interaction. For example, if a system-user approaches the machine with a product related to those to be dispensed, the system may utilize NFC solutions to facilitate system-user interaction with the user's own (customers pre-owned NFC product or accessory) existing user products and interacting with the system to show "sister" or related product for sale. The system can thus be configured to use an NFC module to interact with existing user products of user interacting with the system to show "sister" or related product for sale The NFC solutions may be used as a means of payment and collecting specific information or demographics. The NFC module can be a blue tooth configured module. The system may utilize blue tooth to pair up with a blue tooth enabled hand held device for similar means.

Other embodiments of the automated dispensing system includes systems and methods that facilitate system-user interaction specifically for the purposes of automated self-service product dispensing system as a means for increasing system-user interaction thereby increasing the completion of or causing a higher probability of creating or completing a sales transaction. According to another embodiment, the automated dispensing system includes systems and methods that use a loyalty program or card as an identification means to facilitate system-user interaction. Using "loyalty program or card" with an unattended self-service automated product dispensing system as a means of system-user interaction can thereby increase and cause a higher probability of creating or completing a sales transaction. Further, the unattended self-service automated product dispensing system can be used as a means of using collected data from past or previous sales to establish a "loyalty program" and thereby interact with the system for the purpose of offering discounts based on loyalty or previous sales or other. The system can be configured to use customer analytics to provide a customized presentation of products to be dispensed. Thus, using "consumer interactive operation" with an unattended self-service automated product dispensing system as a means of system-user interaction can thereby increase and cause a higher probability of creating or completing a sales transaction.

Thus, means can be provided for that identify a user. Further, once a user can be identified, social media of the user can be mapped so as to more specifically tailor product or suggestive offerings. For example, in one embodiment, a user's social networks can be mined for key words to determine potential product offerings or suggestions. In one embodiment, if a certain key word or phrase is extracted from social network text, that key word or phrase can be looked up to correspond to a certain product based on that key word or phrase. Further, if a certain key word or phrase appears in the text of a user's social network information at a predetermined frequency, a corresponding likelihood that the user would be interested in a related product or service to that key word or phrase can be calculated and applied to provide suggestive offerings.

According to another embodiment, the automated dispensing system includes systems and methods that discover and convey the wide array of social media interaction to suggest and identify relational products both for sales within the system or via a related "on-line" retail sales site within the access of the WWW (World Wide Web). The on-line retail sales site can thus use the WWW as a means of system-user interaction thereby increasing and causing a higher probability of creating or completing a sales transaction. Such social media interactions may be through "Facebook," "Twitter" "LinkedIn" "Instagram" and other social media icons, web sites or other social media interfaces to utilize the power of "social programming" and social "suggestive sales" such as identifying or suggesting related products or accessories to specifically related to the initial products or interest or to that of being purchased as a means of system-user interaction thereby increasing and causing a higher probability of creating or completing a sales transaction. This invention also discovers and conveys the wide array of today's popular and growing trends on the use of social media social interaction and the power of the system to use suggest and identify relational products both for sales within the system or via a related "on-line" retail sales site within the access of the World Wide Internet (WWI).

An embodiment of the invention uses and identifies the utility of using social media such as "Facebook," "Twitter" "LinkedIn" "Instagram" and other social media icons, web sites or other social media interfaces as a means of system-user interaction thereby increasing and causing a higher probability of creating or completing a sales transaction.

Interactive digital signage relating to the specific product or products can also be used and identified specifically as a utility of this invention as a means of system-user interaction thereby increasing and causing a higher probability of creating or completing a sales transaction.

Power of "social programing" and social "suggestive sales" such as identifying or suggesting related products or accessories to specifically related to the initial products or interest or to that of being purchased is also used and identified specifically as a utility of this invention as a means of system-user interaction thereby increasing and causing a higher probability of creating or completing a sales transaction. Thus, using "Social Programing" and "suggestive sales" with an unattended self-service automated product dispensing system as a means of system-user interaction can thereby increase and cause a higher probability of creating or completing a sales transaction.

Figure 1B:
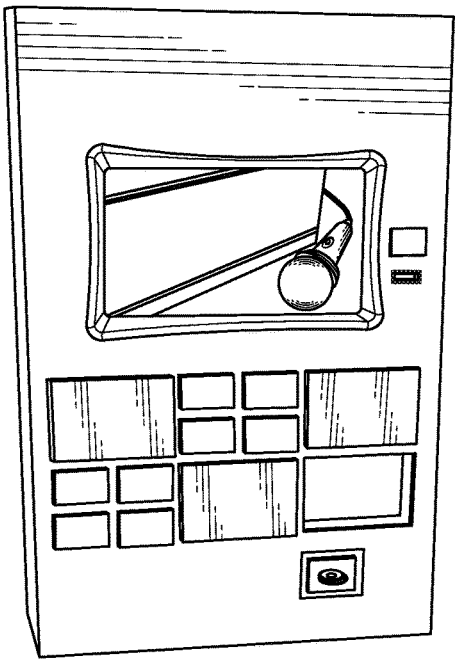
FIG. 1B shows a front-facing view of an automated vending system, in accordance with an embodiment of the invention.

According to another embodiment as depicted in FIGS. 1A and 1B, the automated dispensing system includes systems and methods that utilize a machine façade that resembles products and items to be dispense to facilitate system-user interaction. The system's "total image" such as the specific size and/or shape, the color or texture of the automated self-service product dispensing system, i.e., the specific "look and feel" of the system, is also a means to facilitate system-user interaction. Other "look and feel" features may include unique physical coating or wrap, and/or unique physical signage or labeling. Thus, the automated vending system 100 can have a surface of the exterior housing 110 that is configured to receive an outside wrap.

In addition to the "physical appearance or shape", the automated dispensing system includes systems and methods that utilize interactive sound or audio, lighting and digital signage to facilitate system-user interaction.

The unique lighting specifically for the purposes of automated self-service product dispensing system can also be identified specifically as a utility of this invention as a means of system-user interaction thereby increasing completing or causing a higher probability of creating or completing a sales transaction.

The "total image" specifically for the purposes of automated self-service product dispensing system is also identified specifically as a utility of this invention as a means of system-user interaction thereby increasing completing or causing a higher probability of creating or completing a sales transaction.

Embodiments of the present invention may include apparatuses, housings or components or electrical circuits for performing the operations disclosed herein. An apparatus may be specially constructed for the desired purposes for operation, or it may comprise a general-purpose device selectively activated or reconfigured by a program stored in the device control system such as the system PC or MCB (Master Control Board).

Embodiments presented herein may be implemented in one or a combination of hardware, firmware, and software. Embodiments of the invention may also be implemented as instructions stored on a machine-readable medium, which may be read and executed by a computing platform to perform the operations described herein. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; and others.

In the preceding description and subsequent claims, the terms "computer program medium" and "computer readable medium" may be used to generally refer to media such as, e.g., but not limited to removable storage drive, a hard disk installed in hard disk drive, etc. These computer program products may provide software to computer system. The invention may be directed to such computer program products.

References to "one embodiment," "an embodiment," "example embodiment," "various embodiments," etc., may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

The example embodiments provided herein, however, are merely intended as illustrative examples and not to be limiting in any way.

Thus, disclosed are system and methods that facilitate automated dispensing systems in retail locations. The embodiments of the self-service automated dispensing systems support a self-service feature or utility allowing for the vending or dispensing of an item or product. In addition, the systems include means that enable unique or specific product identification and/or product verification, customer analytics, product and system interaction, façade customization, and/or "form fit and function" within the standards of traditional and non-traditional retail store fixtures or merchandising fixtures, end caps or retail rows/columns or islands to dispense or interact with the product or redemption of a product or item. Thus, the automated vending system can use specific or unique fixture/system in an unattended self-service automated product dispensing system as a means of system-user interaction thereby increasing and causing a higher probability of creating or completing a sales transaction.

In the foregoing specification, the invention has been described with reference to specific embodiments thereof. It will, however, be evident that various modifications and changes may be made thereto without departing from the broader spirit and scope of the invention. For example, the reader is to understand that the specific ordering and combination of process actions shown in the process flow diagrams described herein is merely illustrative, unless otherwise stated, and the invention can be performed using different or additional process actions, or a different combination or ordering of process actions. As another example, each feature of one embodiment can be mixed and matched with other features shown in other embodiments. Features and processes known to those of ordinary skill may similarly be incorporated as desired. Additionally and obviously, features may be added or subtracted as desired. Accordingly, the invention is not to be restricted except in light of the attached claims and their equivalents.

Although this invention has been described in certain specific embodiments, many additional modifications and variations would be apparent to those skilled in the art. It is, therefore, to be understood that this invention may be practiced otherwise than as specifically described.

Thus, the present embodiments of the invention should be considered in all respects as illustrative and not restrictive, the scope of the invention to be determined by any claims supported by this application and the claims' equivalents rather than the foregoing description. The invention, therefore, as defined in the appended claims, is intended to cover all such changes and modifications as fall within the true spirit of the invention.

What is claimed is:

1. An automated vending system for retail locations, comprising:

an exterior housing configured to house a plurality of differently shaped items for purchase and return;

at least one data processor that is disposed in the exterior housing and that is coupled to an external server having a database, the database including information about a plurality of items;

a display device on a face of the exterior housing, the display device being coupled to the data processor and being configured to accept user input for executing a transaction;

a memory storing computer-executable instructions that, when executed by the at least one data processor, cause the automated vending system to execute vending and returning of at least one item of interest;

a payment validation device that is configured to accept payment information from a user, using the data processor, the payment validation device being disposed on or in the exterior housing;

a storage area that is configured to hold a plurality of items, the storage area being inside the exterior housing;

an item compartment that is disposed within the exterior housing and that is capable of opening to the user, using the data processor, the item compartment including:

at least one image sensor that is configured to take a plurality of images of an item to be placed in the compartment by the user; and a scale that is configured to weigh the item to be placed in the compartment;

an item dispenser that is configured to transport, using the data processor, an item from the storage area to the item compartment; and a detector that is positioned to detect foreign activity within the item compartment, using the at least one data processor;

wherein when the accepted user input corresponds to returning at least one item, the at least one item is returned based on the at least one image sensor and the scale generating data that matches the item to the information of the item in the database.

2. The automated vending system of claim 1, wherein:

when the accepted user input corresponds to vending at least one item of interest, the display device is configured to accept user input for selecting the at least one item of interest, the payment validation device is configured to accept payment from the user, and the payment information is received from a user's payment device, and the vending includes i) validating the user's payment device, ii) verifying that sufficient space in the item compartment exists for the selected at least one item, iii) using the detector to detect fraud based on improper user activity being detected, and iv) dispensing the item to the compartment based on the validating, verifying and detecting fraud.

3. The automated vending system of claim 2, wherein when the accepted user input corresponds to purchasing two or more items, the item dispenser dispenses the two or more selected items at once instead of sequentially dispensing the two or more selected items.

4. The automated vending system of claim 2, wherein when the accepted user input corresponds to purchasing two or more items, each selected item is sequentially dispensed, wherein the item dispenser dispenses a first item to the item compartment and does not dispense a next item until a predetermined event.

5. The automated vending system of claim 4, wherein the predetermined event is detecting that the first item and foreign activity are free from the item compartment.

6. The automated vending system of claim 5, wherein the predetermined event includes detecting a hand that removes the first item.

7. The automated vending system of claim 2, wherein upon the user selecting an item for purchase, the display device offers related items for sale.

8. The automated vending system of claim 1, wherein the memory further includes computer-executable instructions that, when executed by the data processor, connect to the database to:

determine whether the user's payment information has a history of fraudulent returns;

compare images from the at least one image sensor to identify the item to be returned;

verify that a weight of the item corresponds with a predefined weight of the item in the database; and determine that a return is appropriate based on the steps of determining the history, comparing the images, and verifying the weight.

9. The automated vending system of claim 1, further comprising a return bin, wherein the memory further includes computer-executable instructions that, when executed by the data processor when it has been determined that a return is appropriate, cause the at least one item to be transported to the return bin.

10. The automated vending system of claim 9, wherein when the at least one item has been returned, the user is prompted to receive a return of a monetary value of the returned item, an exchange of the monetary value of the item for an item of equal or lesser value, or a redemption ticket for redeeming the item at a future time and/or at another location.

11. The automated vending system of claim 1, wherein the automated vending system is positionable within merchandising fixtures, end caps or retail rows/columns or islands of retail stores, wherein the exterior housing has a width of about 48" and a height of about 60".

12. The automated vending system of claim 1, wherein the automated vending system is configured as a mobile unit for ambulatory use or recovery in retail locations.

13. The automated vending system of claim 1, further comprising:

a plurality of wheels attached to a bottom face of the automated vending system; and leveling feet that are adjustable to a height greater than a height of the wheels.

14. The automated vending system of claim 1, further comprising an audio output device that is configured to produce sounds, the audio output device being tailored to output according to each step of the transaction.

15. The automated vending system of claim 1, wherein a surface of the exterior housing is configured to receive an outside wrap.

16. The automated vending system of claim 1, further comprising an integrated desensitizer that deactivates theft-deterrent strips upon executing the transaction to deactivate an RF or magnetic theft deterrent security strip.

17. A plurality of automated vending systems according to claim 1, wherein each of the automated vending systems are connected to the external server and wherein a transaction at one automated vending system can be used at another automated vending system.

18. The automated vending system of claim 1, further comprising a user-facing image sensor mounted on or in the face of the exterior housing, wherein upon sensing a human within a predetermined range of the automated vending system, the image sensor captures an image of the human, wherein the image of the human is analyzed for demographic information and matched using images from a certain subset of images stored in the database, the subset being defined by geographical area, and wherein the display device provides content customization based on the analyzed and matched image.

19. The automated vending system of claim 1, further comprising a personal identification input device that accepts personal information from the user, wherein the personal information is matched against historical data of the user and/or personal reference data of the user, and wherein the display device is configured to display customized content to the user based on the matched personal information.

* * * * *